US009920590B2

(12) United States Patent
Fenwick

(10) Patent No.: US 9,920,590 B2
(45) Date of Patent: Mar. 20, 2018

(54) TUBING HANGER ANNULUS ACCESS PERFORATED STEM DESIGN

(71) Applicant: Vetco Gray Inc., Houston, TX (US)

(72) Inventor: Rodney Mark Fenwick, Aberdeen (GB)

(73) Assignee: Vetco Gray, LLC, Houston, TX (US)

( * ) Notice: Subject to any disclaimer, the term of this patent is extended or adjusted under 35 U.S.C. 154(b) by 1065 days.

(21) Appl. No.: 14/063,548

(22) Filed: Oct. 25, 2013

(65) Prior Publication Data

US 2015/0114619 A1 Apr. 30, 2015

(51) Int. Cl.

| | |
|---|---|
| ***E21B 34/02*** | (2006.01) |
| ***E21B 33/03*** | (2006.01) |
| ***E21B 33/04*** | (2006.01) |

(52) U.S. Cl.

CPC ..... *E21B 34/02* (2013.01); *E21B 33/03* (2013.01); *E21B 33/04* (2013.01)

(58) Field of Classification Search

CPC ..... E21B 19/00; E21B 34/02; E21B 33/03; E21B 19/06; E21B 33/04; E21B 33/0422

See application file for complete search history.

(56) References Cited

U.S. PATENT DOCUMENTS

| | | | | |
|---|---|---|---|---|
| 3,666,012 | A * | 5/1972 | Sizer | E21B 23/03 166/313 |
| 3,693,714 | A * | 9/1972 | Baugh | E21B 33/047 166/348 |
| 4,540,047 | A * | 9/1985 | Akkerman | E21B 23/03 166/117.5 |
| 5,193,615 | A * | 3/1993 | Akkerman | E21B 23/03 166/117.5 |
| 5,769,162 | A | 6/1998 | Bartlett et al. | |
| 7,407,011 | B2 | 8/2008 | Kent | |
| 8,371,385 | B2 | 2/2013 | Lewis | |
| 8,403,039 | B2 | 3/2013 | Howell | |
| 8,469,086 | B2 * | 6/2013 | Donald | E21B 33/03 166/368 |
| 9,359,845 | B2 * | 6/2016 | Grodem | E21B 33/143 |
| 2003/0019632 | A1 | 1/2003 | Humphrey et al. | |
| 2005/0028984 | A1 * | 2/2005 | Donald | E21B 33/035 166/368 |

(Continued)

OTHER PUBLICATIONS

International Search Report and Written Opinion issued in connection with corresponding PCT Application No. PCT/US2014/060809 dated May 8, 2015.

*Primary Examiner* — Brad Harcourt
(74) *Attorney, Agent, or Firm* — Hogan Lovells US LLP

(57) ABSTRACT

A wellhead assembly including a tubing hanger adapted to be connected to a tubing string and landed in a wellhead, and defining a tubing annulus between the tubing string and casing in a well. The wellhead assembly also includes a tubing annulus upper access bore extending downward from an upper end of the tubing hanger, and a tubing annulus lower access bore extending upward from a lower end of the tubing hanger and misaligned with the upper access bore, the lower access bore adapted to communicated with the tubing annulus. A communication cavity connects the upper and lower access bores within the tubing hanger. A remotely actuated valve is in the communication cavity for selectively opening and closing communication between the lower access bore and the upper access bore.

19 Claims, 13 Drawing Sheets

(56) References Cited

U.S. PATENT DOCUMENTS

2006/0237194 A1* 10/2006 Donald ..... E21B 34/04
166/369
2012/0160513 A1 6/2012 Bryson

* cited by examiner

TUBING HANGER ANNULUS ACCESS PERFORATED STEM DESIGN

BACKGROUND OF THE INVENTION

1. Field of the Invention

This technology relates to oil and gas wells. In particular, this technology relates to valves to control the flow of annular fluid from the annulus of a well through a tubing hanger.

2. Brief Description of Related Art

Typical drilling operations include a high pressure wellhead having a tubing hanger mounted therein. The purpose of the tubing hanger is to support tubing extending into the well. Typical tubing hangers include a production bore which extends vertically through the hanger. After the tubing hanger is set access to the annulus of the well is impeded by the body of the tubing hanger, as well as by other wellhead equipment. Despite the difficulty of accessing the annulus, however, there remains a need after the tubing hanger is set to access the annulus for such things as testing and monitoring of annular fluid. One way to access such annular fluid is by providing a port through the tubing hanger from the top of the tubing hanger to the annulus. Such a port should have a valve for controlling access to the annular fluid and limiting access to appropriate times in the production and completion process.

SUMMARY OF THE INVENTION

Disclosed herein is a wellhead assembly that may include a wellhead housing attached to a wellhead, and a production tree having a production bore and attached to the top of the wellhead housing. A tubing hanger is adapted to be connected to a tubing string and landed in the wellhead housing, the tubing hanger having a production bore and defining a tubing annulus between the tubing string and casing in a well. The assembly may further include an isolation sleeve positioned between the tubing hanger and the production tree, the isolation sleeve having a bore that provides fluid communication between the production bore of the tubing hanger and the production bore of the production tree.

A tubing annulus upper access bore extends downward from an upper end of the tubing hanger, and a tubing annulus lower access bore extends upward from a lower end of the tubing hanger, and is misaligned with the upper access bore. The lower access bore is adapted to communicate with the tubing annulus. In some embodiments, the upper and lower tubing annulus access bores may be parallel to each other and circumferentially spaced apart.

A communication cavity connects the upper and lower access bores within the tubing hanger. In some embodiments, the communication cavity may extend axially parallel to the access bores and circumferentially spaced between the access bores. A remotely actuated valve is positioned in the communication cavity for selectively opening and closing communication between the lower access bore and the upper access bore. In certain embodiments, the valve may include a perforated valve stem having an axially extending flow chamber therein. The flow chamber defines a bottom end, a top end, and cylindrical sidewalls with perforations extending therethrough.

A first lateral port extends from the lower access bore to the flow chamber, and a second lateral port extends from the upper access bore to the flow chamber, so that when the valve is in an open position, the flow chamber is in communication with the first and second lateral ports, and when the valve is in a closed position, communication between the flow chamber and at least one of the lateral ports is blocked.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE PREFERRED EMBODIMENTS

Figure 1:
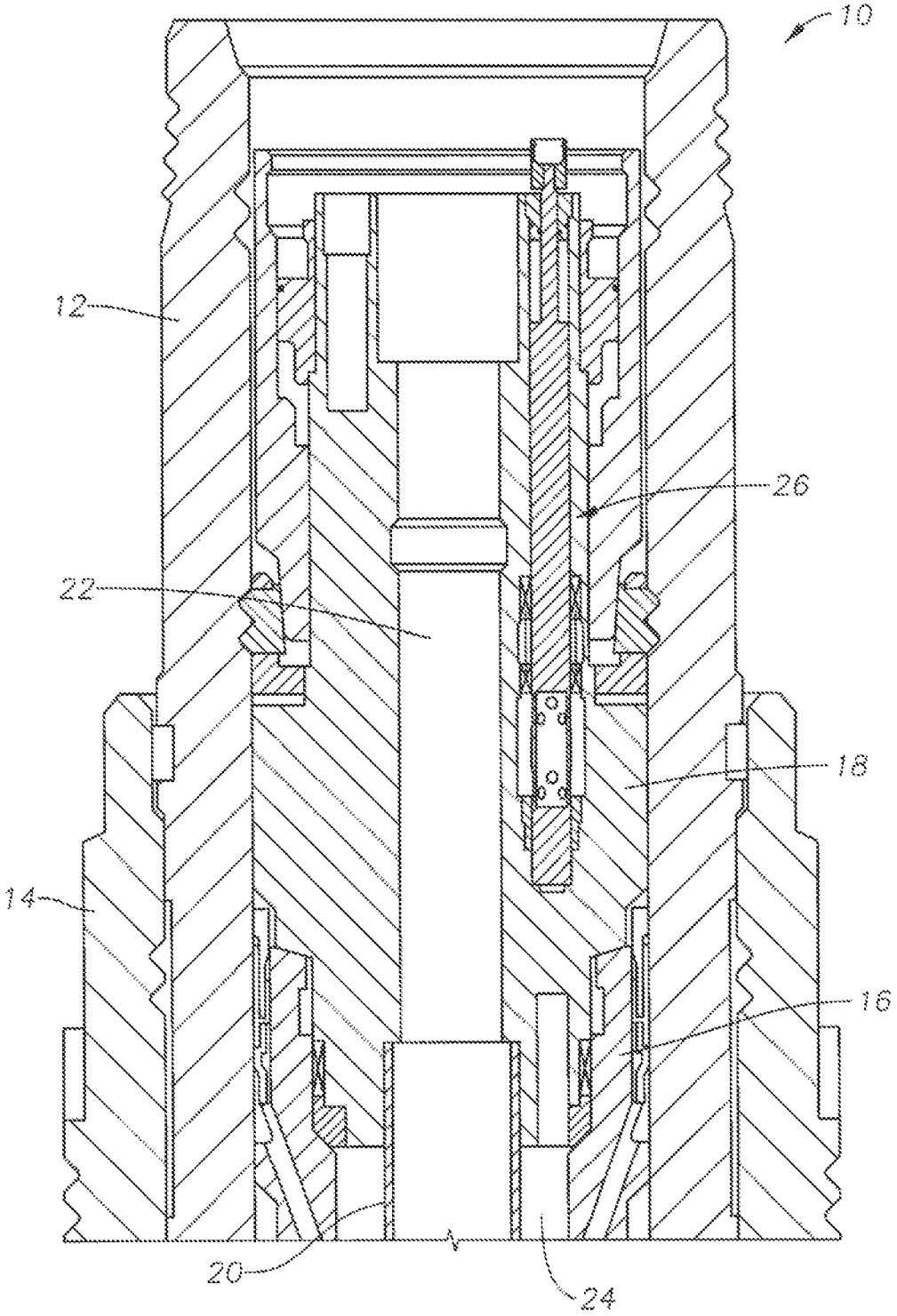
FIG. 1 is a side cross-sectional view of a wellhead assembly according to an embodiment of the present technology.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

FIG. 1 is a depiction of a wellhead assembly 10 according to an embodiment of the present technology. The wellhead assembly may include such features as a wellhead housing 12 mounted within a wellhead 14. A casing hanger 16 may be positioned within the wellhead housing 12 to support casing, and a tubing hanger 18 may be inserted above the casing hanger 16. In some embodiments, the tubing hanger 18 may be a five inch nominal concentric vertical tubing hanger, although other sizes are possible (e.g., six inch, seven inch, etc.). The tubing hanger 18 may typically support tubing 20 extending into the well, and may rest on, and be at least partially supported by the casing hanger 16. The tubing hanger 18 includes a production bore 22 which provides access through the tubing hanger 18 to the tubing 20. The area around the tubing 20, and between the tubing hanger 18 and the casing, is an annulus 24 of the well.

During well operations, it may be desirable for an operator to access fluid in the annulus 24 to analyze conditions in the annulus 24, such as temperature, composition of annular fluid, etc. Accordingly, annulus access valve assembly 26 is provided in the wellhead assembly 10 to provide access between the annulus 24 and the top of the tubing hanger 18, thereby allowing monitoring of annular fluid through a tubing hanger running tool (shown, e.g., in FIG. 6) or production tree (shown, e.g., in FIG. 5A) in communication with the top of the tubing hanger 18. As used herein, the term valve has an expansive definition, and refers to any sealing mechanism or device that may be used to control the flow of annular fluid through the tubing hanger. The annulus access valve assembly 26 may be configured to have a working pressure rating of up to 10,000 pounds per square inch (psi) or more, and may typically allow access to the annulus with an operating pressure of 3,000 to 5,000 psi. Once annular fluid is brought from the annulus 24 to the top of the well, the operator can easily access the annular fluid for analysis and testing.

Figure 2A:
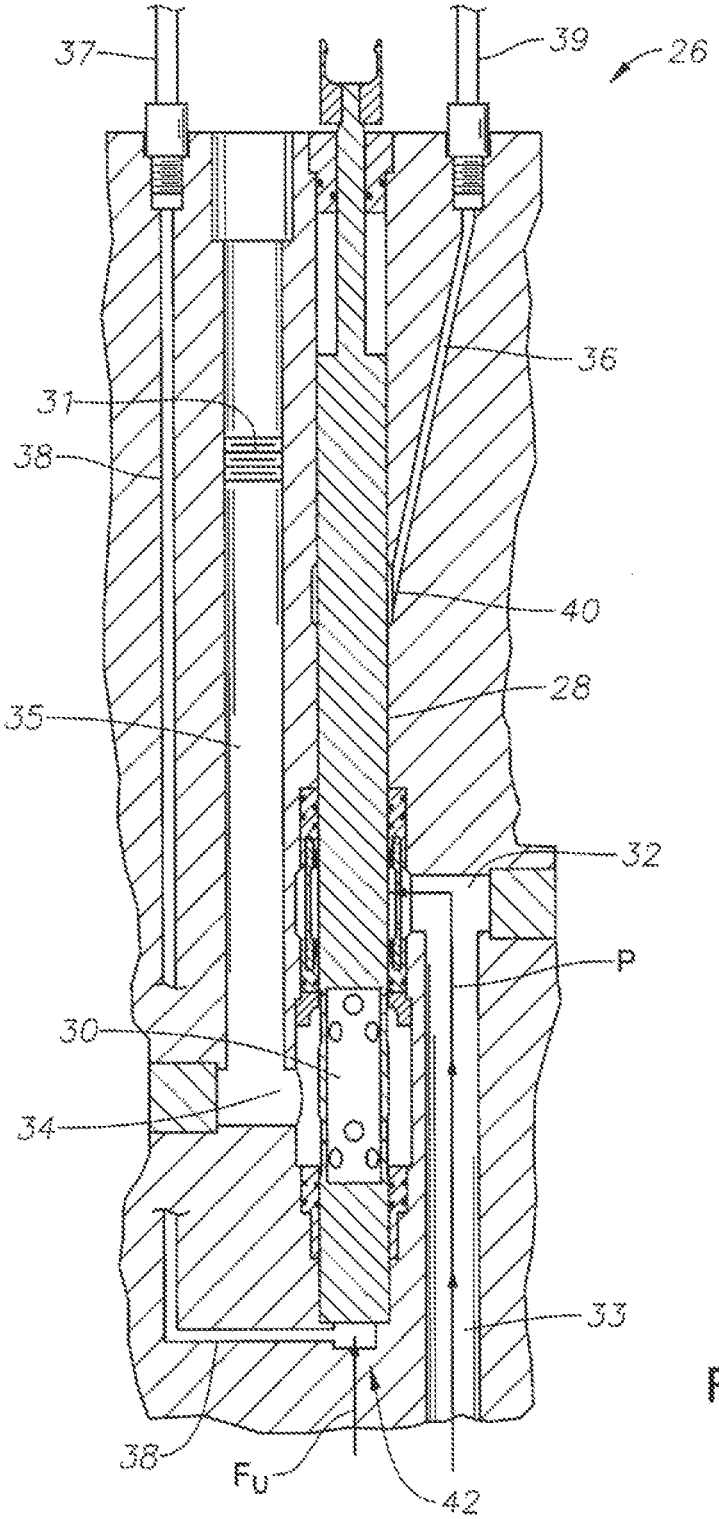
FIG. 2A is an enlarged side cross-sectional view of a perforated stem according to an embodiment of the technology in a closed position.
Figure 2B:
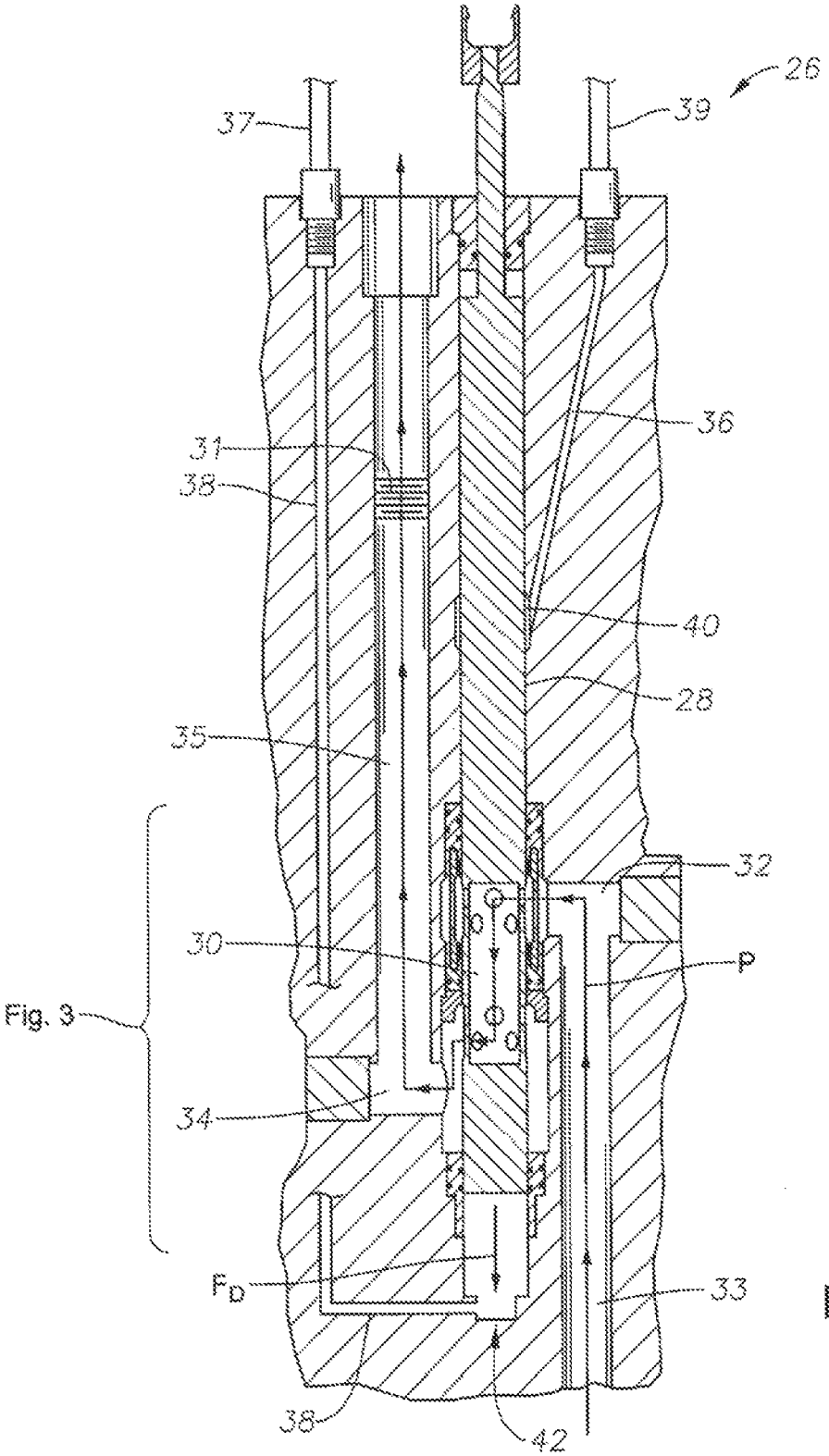
FIG. 2B is an enlarged side cross-sectional view of a perforated stem according to an embodiment of the technology in an open position.

Referring now to FIGS. 2A and 2B, there is illustrated an enlarged view of the annular access valve assembly 26 shown in FIG. 1. The annular access valve assembly 26 includes a valve body 28 having a valve chamber 30. In the embodiments shown, the valve body 28 is positioned in a vertical configuration in the tubing hanger 18. In FIG. 2A, the valve body 28 is shown in a closed position, and in FIG. 2B, the valve body 28 is shown in an open position. A first side of the valve body 28 is fluidly engaged with a lower access port 32, which is in turn in fluid communication with a lower annular access bore 33. A second side of the valve body 28 is fluidly engaged with an upper access port 34, which is in turn in fluid communication with an upper annular access bore 35. The upper annulus access bore opens to the top of the tubing hanger 18. In some embodiments, the upper annular access bore 35 can have a profile 31, which may be threaded or otherwise, to accept a backup plug (not shown). Such a backup plug may be useful for plugging the upper annular access bore 35 if desired, such as, for example, when the production tree is removed from the tubing hanger 18 subsea.

In FIGS. 2A and 2B, the flow path of annular fluid is shown by arrows P. When the valve body 28 is in a closed position, as shown in FIG. 2A, the valve chamber 30 does not align with the lower access port 32, and fluid is prevented from flowing from the lower access port 32 into the valve chamber 30. Thus, fluid communication between the lower access port 32 and the upper access port 34 is prevented.

Conversely, when the valve body 28 is in an open position, as shown in FIG. 2B, the valve chamber 30 aligns with the lower access port 32. Thus, fluid is free to flow from the lower access port 32 into the valve chamber 30. The valve chamber 30 is also open to the upper access port 34, as described in greater detail below, so that when the valve body 28 is open, fluid may freely flow from the lower access port 32, through the valve chamber 30, and into the upper access port 34, thereby providing fluid access from the lower access port 32 to the upper access port 34 of the tubing hanger 18.

Also shown in FIGS. 2A and 2B is a lower hydraulic control line 38, which may be accessed through the production tree or running tool. The lower hydraulic control line 38 may provide hydraulic fluid to an area 42 below the valve chamber 30, and allow for hydraulic control of the position of the valve body 28 from below. For example, when the valve body 28 is in a closed position, as shown in FIG. 2A, hydraulic fluid can be provided to area 42, thereby providing a hydraulic force $F_U$ on the valve body that acts in an upward direction. Such a hydraulic force $F_U$ pushes the valve body 28 upward from the closed to the open position. Conversely, when the valve body 28 is in the open position, as shown, for example, in FIG. 2B, hydraulic fluid may be provided to area 40 via fluid port 36, thereby providing an opposite hydraulic force $F_D$ that pushes the valve body 28 downward from the open position to the closed position. Accordingly, the position of the valve body 28 can be controlled by means of the upper and lower control lines 36 and 38. Furthermore, standard slim couplers, as used on various known tubing hanger systems, may be used to control hydraulic valves connected to the hydraulic lines 36 and 38.

Figure 3:
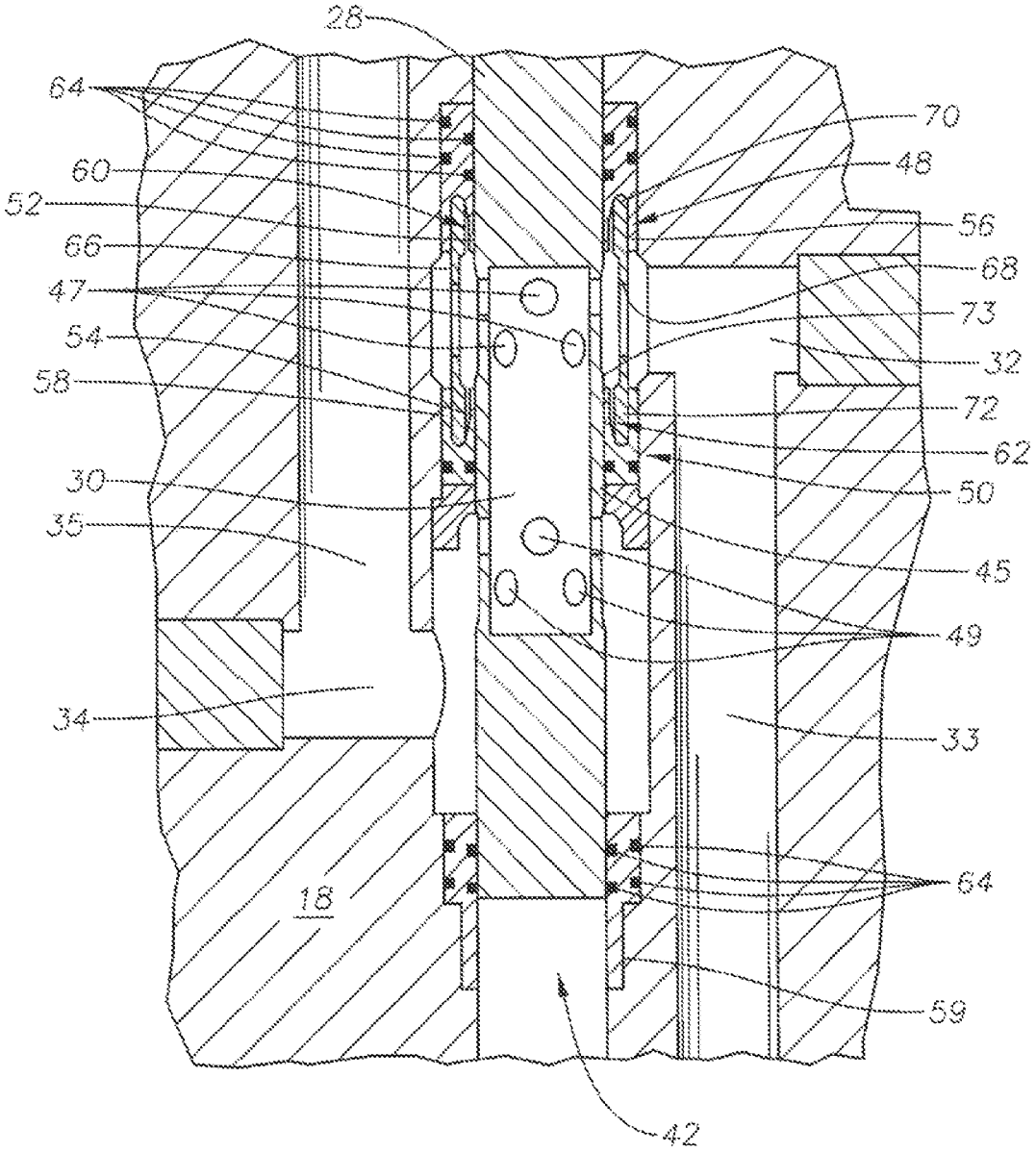
FIG. 3 is an enlarged side cross-sectional view of the opening in the perforated stem of FIG. 2B.

Referring now to FIG. 3, there is shown an enlarged view of the valve chamber 30 and other components. As shown, valve chamber 30 is a void contained within the valve body 28. The valve chamber 30 is enclosed by sidewalls 45 which form cylindrical sealing surfaces, and which are integral to, and form a portion of, the valve body 28. The sidewalls 45 have upper openings 47 and lower openings 49 that provide access between the valve chamber 30 and the outside of the valve body 28. The upper and lower openings 47, 49 are located at an upper end 30A and a lower end 30B of the valve chamber 30 respectively.

FIG. 3, the valve body 28 is in the open configuration. At the interface between the lower access port 32 and the valve body 28, there are seals that prevent annular fluid from leaking past the valve body 28 and the tubing hanger 18. These seals include upper and lower metal seals 48, 50, whose purpose is to form a dynamic seal against the surface of the valve body 28, even as the valve body moves upward and downward between open and closed positions. Each of upper and lower metal seals 48, 50 is substantially cylindrical and surrounds the valve body 28. Each of the upper and lower metal seals 48, 50 also has a substantially U-shaped cross-section with a first metal seal leg 52, 54 that extends substantially adjacent to the valve body 28, and a second metal seal leg 56, 58 that extends substantially adjacent to the tubing hanger 18. Also shown is a stem seal ring 59 for sealing the interface between the valve body 28 and the tubing hanger 18 at the bottom end of the valve body 30.

In practice, the area 60, 62 between the first and second metal seal legs of each seal 48, 50 fills with annular fluid, and the annular fluid exerts pressure forces outwardly from the areas 60, 62, including against the first 52, 54 and second 56, 58 metal seal legs. The first metal seal leg 52, 54 of each seal is dynamic, so that as pressure from the annular fluid acts on the first metal seal legs 52, 54, they are elastically deformed, and pushed into sealed engagement with the valve body 28 so that no fluid can pass between the metal seals 48, 50 and the valve body 28. In some embodiments, the first metal seal legs 52, 54 may be resilient and biased against the valve body 28 even before annular fluid pressure is applied. The second metal seal legs 56, 58 may be static, and may have thicker cross-sections than the first metal seal legs 52, 54. The second metal seal legs 56, 58 are configured to seal against the tubing hanger 18 so that no fluid can pass between the upper and lower metal seals 48, 50 and the tubing hanger 18. In alternative embodiments (not shown), the metal seals 48, 50 may each be symmetrical, with both the first 52, 54 and second 56, 58 metal seal legs being dynamic and elastically deformable.

In the embodiments shown, the inside surface of the first metal legs 52, 54 of the upper and lower metal seals 48, 50 is substantially straight and adjacent to the surface of the valve body 28 along the entire height of the seal 48, 50. Such an arrangement is advantageous because it allows transmission of pressure forces from the first metal legs 52, 54 and into the valve body 28 over the entire height of the seal 48, 50. This design is in contrast to other known seal designs, many of which include a sealing surface proximate the stem of a valve body that tapers away from the valve body along part of the height of the seal. Such tapered designs can be problematic because they can lead to high stresses in the first metal legs 52, 54, which can in turn lead to failure of the seals. In the design of the present technology, such stresses are eliminated, thereby increasing the reliability of the upper and lower metal seats 48, 50, as well as increasing the amount of pressure that the seals 48, 50 can withstand. In addition, in some embodiments, the sealing surfaces of the upper and lower metal seals 48, 50 may be coated with a seal coating. Additional elastomer seals 64 are provided as backup seals to the upper and lower metal seals 48, 50, and also to seal the interfaces between the stem seal ring 59, the valve body 28, and the tubing hanger 18. These elastomeric seals can also serve to seal off area 40 above the seals.

A seal spacer 66 having openings 68, is provided between the upper and lower metal seats 48, 50. Upper and lower ends 70, 72 of the seal spacer 66 extend into the area 60, 62 between the first and second metal seal legs of each seal 48, 50 and contact the seals 48, 50. The seal spacer 66 is not an energizing member, but rather serves to maintain the relative axial positions of the upper and lower metal seals 48, 50 relative to one another, thereby preventing the seals 48, 50 from moving toward one another and blocking the annular access port 32. The openings 68 in the seal spacer 66 allows the annular fluid to pass through the seal spacer 66 and into the valve chamber 30 through the upper openings 47 in the sidewalls 45 when the valve body 28 is in the open position, as shown in FIG. 3. In addition, the surface of the valve body 28 may be provided with a step 73. This step 73 serves to prolong the life, and reduce or eliminate damage to, the lower metal seal 50 and the back up seals 64 by reducing contact between the sidewalk 45 of the valve body 28 and the lower metal seal 50 and back up seals 64 as the valve body 28 moves from the open to the closed position.

Figure 4:
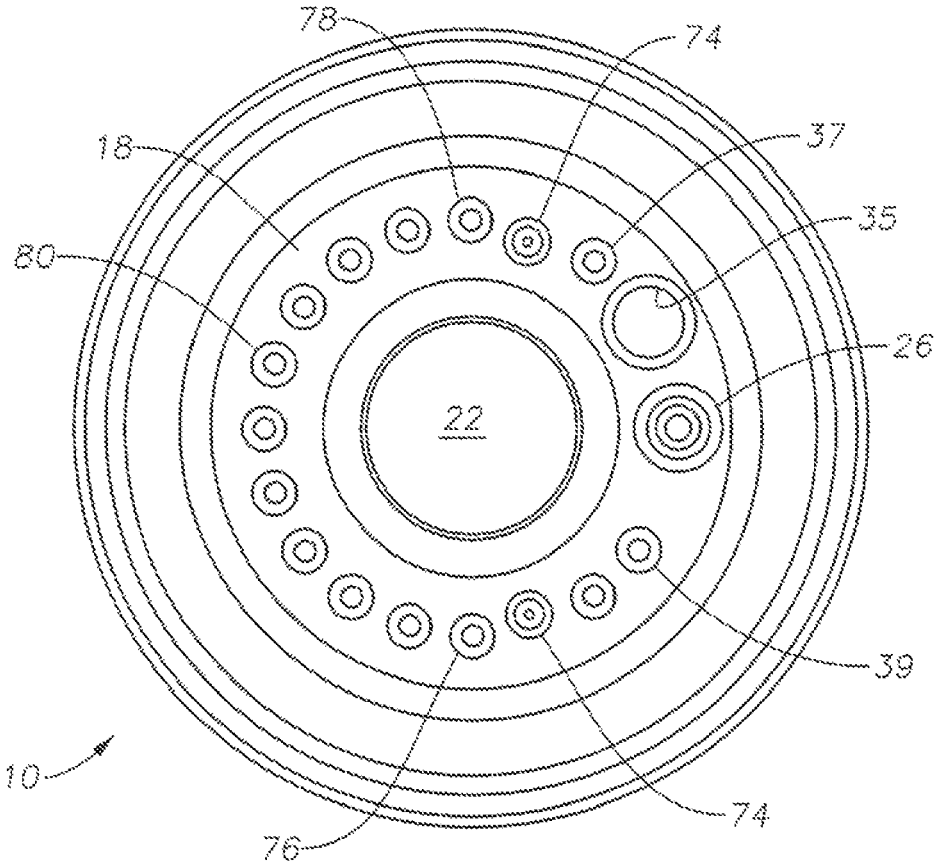
FIG. 4 is a top view of certain components of the wellhead assembly of FIG. 1.

Referring to FIG. 4, there is depicted a top view of the wellhead assembly 10 according to an embodiment of the present technology, without the high pressure wellhead 12 or the connector 14 (shown in FIG. 1). In FIG. 4, the tubing hanger 18 is shown, along with annulus access assembly 26, the production bore 22, the upper annular access bore 35, the lower hydraulic control line coupler 37, and the upper hydraulic control line coupler 39. Also shown are additional components, such as connectors 74 for down hole pressure and temperature (DHPT) sensors, a tubing hanger land confirm sensor 76, a tubing hanger lock confirm sensor 78, as well as extra hydraulic couplers 80 for attachment to additional components that may be added to the assembly in the future.

Figure 5A:
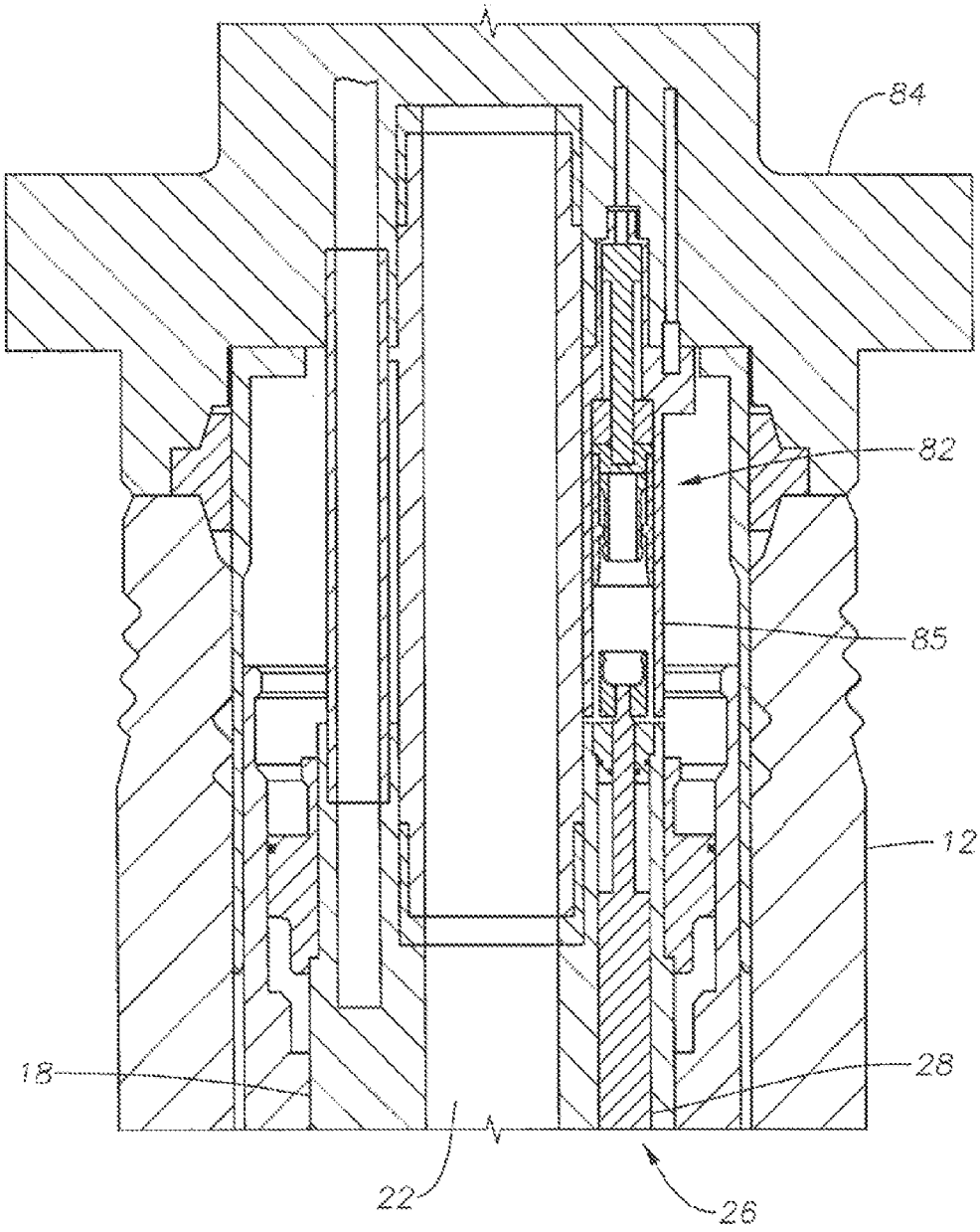
FIG. 5A is a side cross-sectional view of a tree override assembly according to an embodiment of the present technology.

FIG. 5A depicts an alternate embodiment of the present technology that provides a different way to move the valve body 28 between an open and a closed position. In particular. FIG. 5A shows a tree override unit 82 that may be attached to a production tree 84, and positioned above the annular access assembly 26 when the tree 84 is placed over the wellhead housing 12. An override extension 85 is shown positioned between the tree 84 and the tubing hanger 18. Typically, such an override would be activated if the primary hydraulic functions fail, although this is not necessary.

Figure 5B:
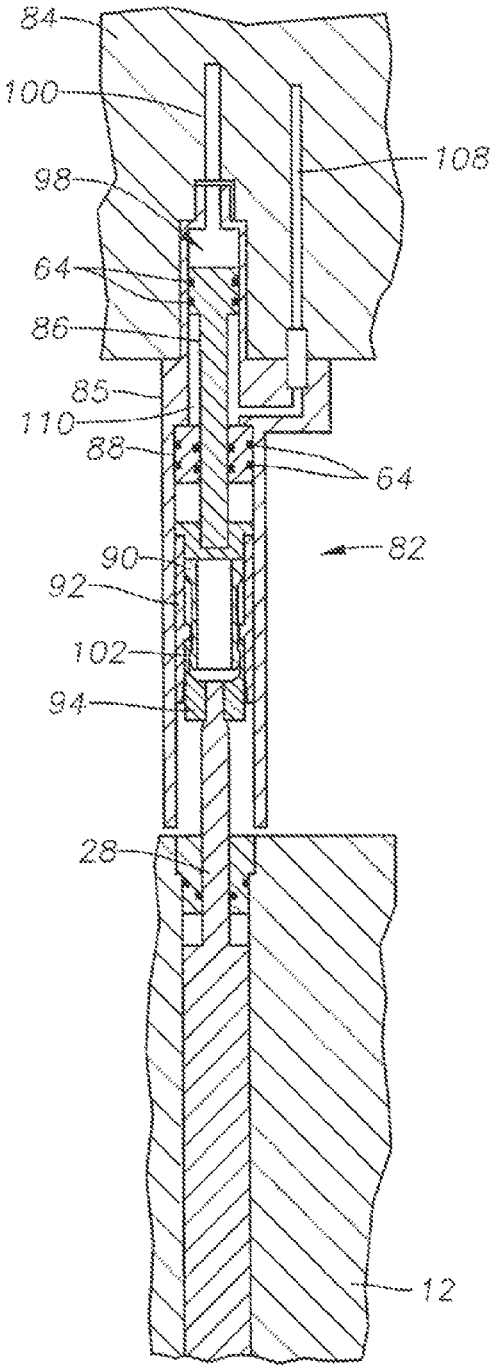
FIG. 5B is an enlarged side cross-sectional view of the top of a perforated stem and override assembly, when the perforated stem is in the open position.
Figure 5C:
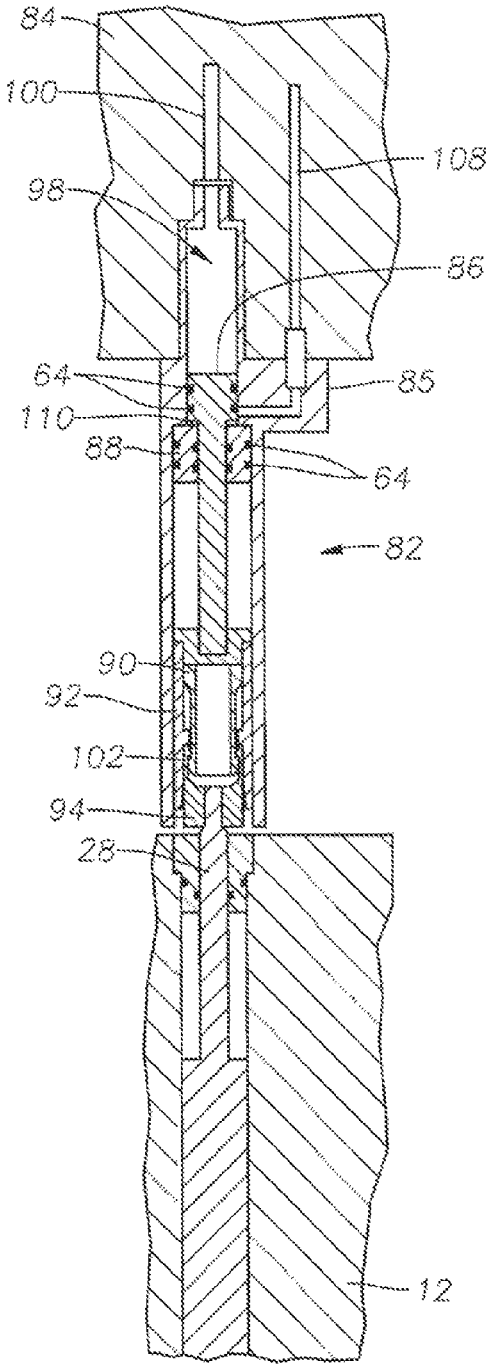
FIG. 5C is an enlarged side cross-sectional view of the top of a perforated stem and override assembly, when the perforated stem is in the closed position.

As best shown in FIGS. 5B and 5C, the tree override unit 82 may include an override extension 85 that includes an override piston 86, a seal housing 88, a dog ring 90, and an override sleeve 92. The top of the valve body 28 may include an override head 94 having inward protrusions 96 (best shown in FIG. 6). When the tree 84 is positioned above the high pressure housing 12, the override extension 85 is substantially axially aligned with the valve body 28. The override piston 86 and seal housing 88 seal against the override extension 85 so that fluid cannot pass between any of the override piston 86, the seal housing 88, or the override extension 85. To ensure a sealed interface between these components, elastomeric seals 64 can be provided between the override piston 86 and the seal housing 88, between the override extension 85 and the override piston 86, and between the override extension 85 and the seal housing 88, as shown.

In practice, hydraulic fluid can be introduced to an area 98 above the override piston 86 by means of a hydraulic line 100 or the area 110 below the override piston 86 by means of a hydraulic line 108. The hydraulic fluid drive the override piston 86 downwardly as the fluid enters the area 98. The dog ring 90, which is attached to the end of the override piston 86, has outward facing dog edges 102 that are configured to engage the inward protrusion 96 of the override head 94 at the top of the valve body 28. The override sleeve 92 surrounds the override head 94 on an outside surface thereof. Once attached, the override head 94 and valve body 28 are coupled to the override piston 86 via the dog ring 90 and the override sleeve 92. As hydraulic fluid is pushed into area 98 through the hydraulic line 100, the override piston 86, and consequently the override head 94 and valve body 28, are pushed downward, as shown in FIG. 5C. This downward movement of the valve body 28 causes the valve body 28 to move into a closed position, as described above. Conversely, the introduction of hydraulic fluid to area 110 causes the override piston 86, override head 94, and valve body 28 to rise, as shown in FIG. 5B, thereby moving the valve body 28 into an open position. Though not shown, the valve body may be attached to both the tree override unit 82 and the upper and lower hydraulic lines 36 and 38 simultaneously. Thus, an operator may have multiple different mechanisms for controlling the annulus access valve assembly 26.

Figure 6:
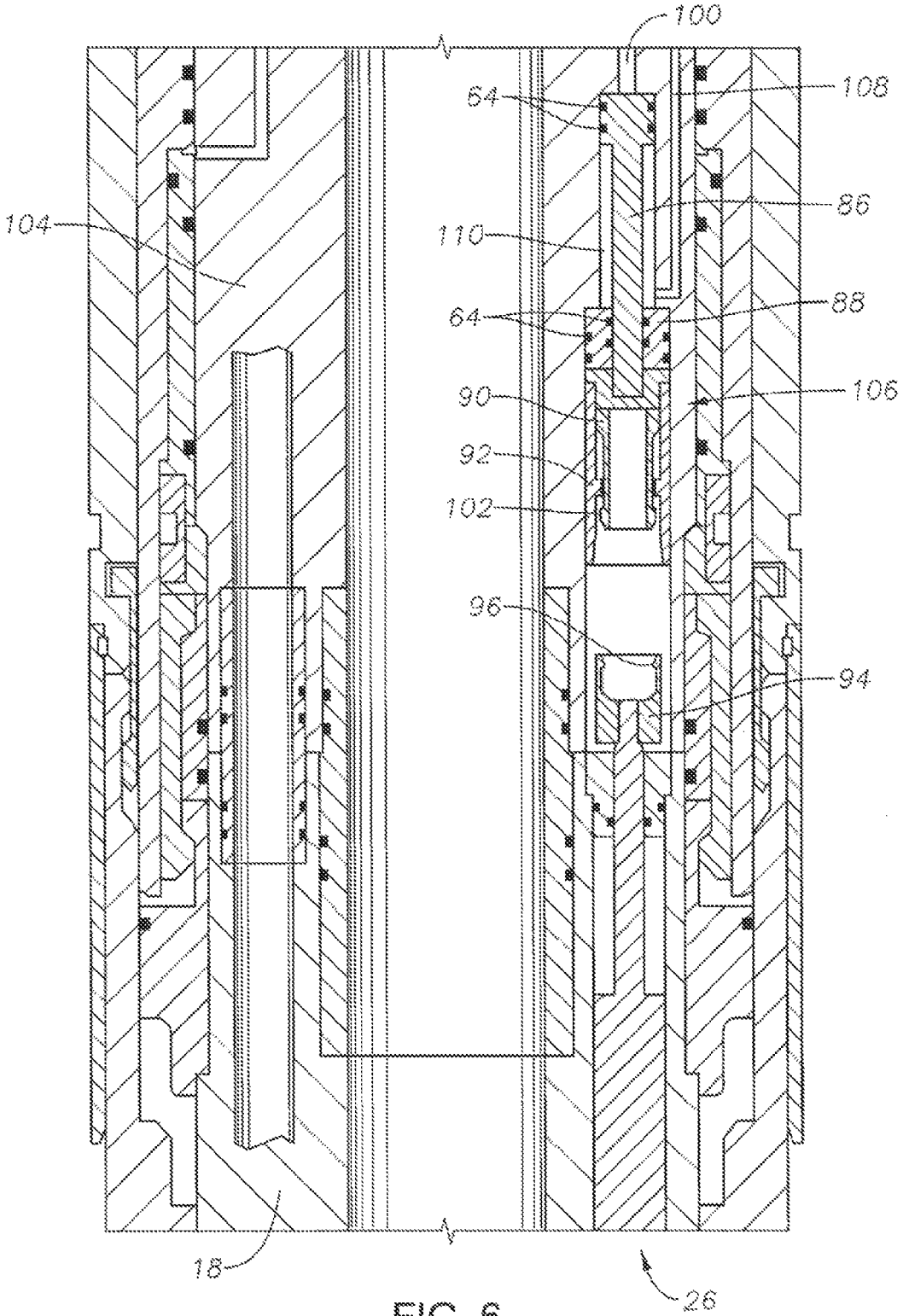
FIG. 6 is an enlarged side cross-sectional view of a running tool override assembly according to an embodiment of the present technology.

Referring to FIG. 6, there is shown an annulus access valve assembly 26 in a tubing hanger 18, and having a tubing hanger running tool 104 attached thereto. The tubing hanger running tool 104 includes a running tool override unit 106 substantially similar to the tree override unit 82 shown in FIG. 5A. The running tool override unit 106 is positioned above the annular access assembly 26 when the running tool 104 is placed over the tubing hanger 18.

Like the tree override unit 82, the running tool override unit 106 may include an override piston 86, a seal housing 88, a dog ring 90, and an override sleeve 92. The top of the valve body 28 may include an override head 94 having inward protrusions 96. When the running tool 104 is positioned above the tubing hanger 18, the override piston 86 is substantially axially aligned with the valve body 28. The override piston 86 and seal housing 88 seal against the running tool 104 so that fluid cannot pass between any of the override piston 86, the seal housing 88, or the running tool 104. To ensure a sealed interlace between these components, elastomeric seals 64 can be provided between the override piston 86 and the seal housing 88, between the running tool 104 and the override piston 86, and between the running tool 104 and the seal housing 88, as shown.

In practice, hydraulic fluid can be introduced above the override piston 86 by means of a hydraulic line 100 or the area 110 below the override piston 86 by means of a hydraulic line 108. The hydraulic fluid can drive the override piston 86 downwardly or upward as the amount of fluid introduced above or below the override piston 86 is varied. The dog ring 90, which is attached to the end of the override piston 86, has outward facing dog edges 102 that are configured to engage the inward protrusion 96 of the override head 94 attached to the valve body 28. The override sleeve 92 surrounds the override head 94 on an outside surface thereof. Once attached, the override head 94 and valve body 28 are coupled to the override piston 86 via the dog ring 90 and the override sleeve 92. As hydraulic fluid is introduced above the override piston 86 through the hydraulic line 100, the override piston 86, and consequently the override head 94 and valve body 28, are pushed downward. This downward movement of the valve body 28 causes the valve body 28 to move into a closed position, as described above. Conversely, the introduction of hydraulic fluid to area 110 causes the override piston 86, override head 94, and valve body 28 to raise, thereby moving the valve body 28 into an open position. As in the embodiment of FIGS. 5A-5C, the valve body may be attached to the tool override unit 106, the upper hydraulic line 36, and the lower hydraulic 38. Thus, an operator may have multiple different mechanisms for controlling the annulus access valve assembly 26.

Figure 7A:
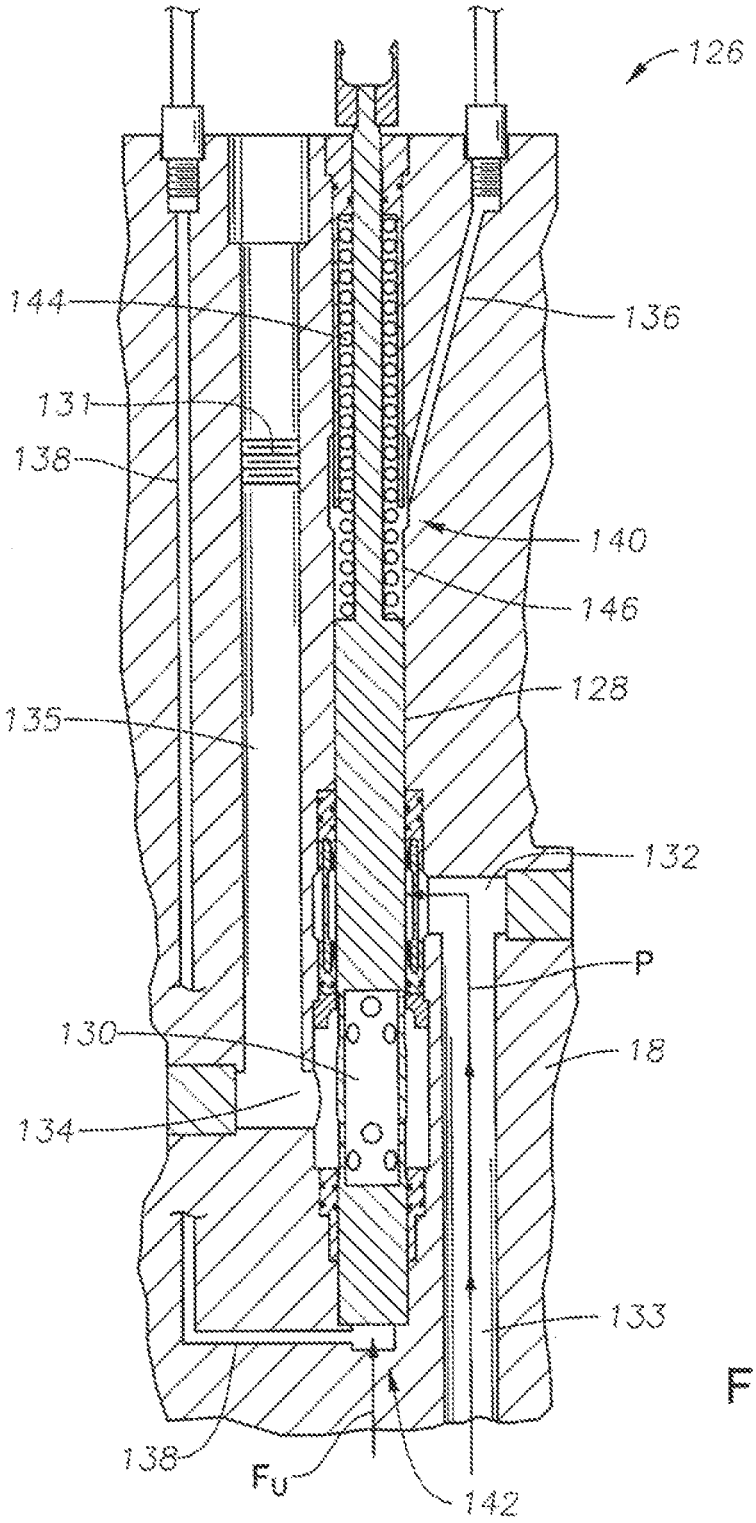
FIG. 7A is a side cross-sectional view of an alternate embodiment of the present technology, including a biasing mechanism and where the perforated stem is in a closed position.
Figure 7B:
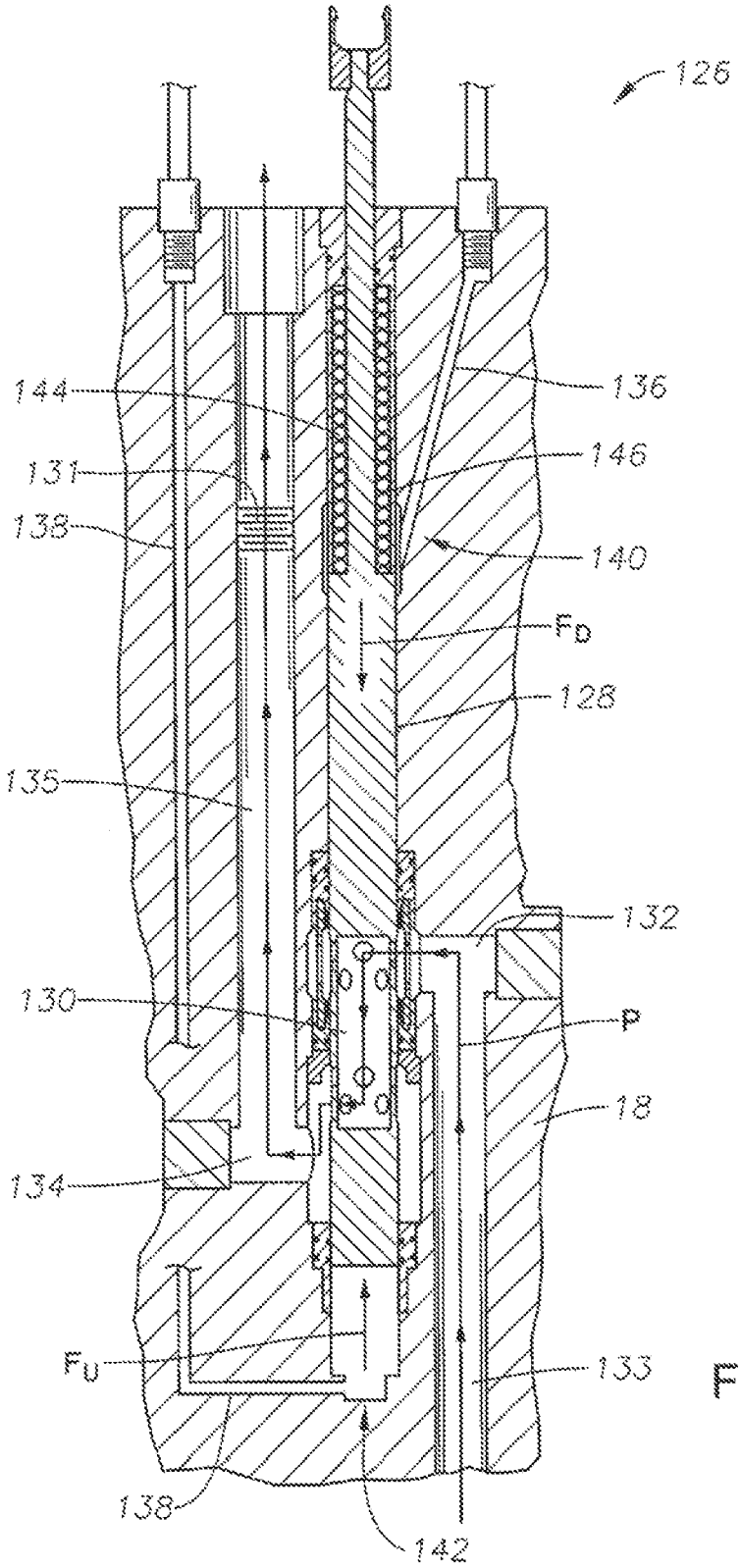
FIG. 7B is a side cross-sectional view of the embodiment of FIG. 7A, where the perforated stem is in an open position.

FIGS. 7A and 7B show an alternate embodiment of the annular access valve assembly 126. The annular access valve assembly 126 includes a valve body 128 having a valve chamber 130. As in the embodiment of FIGS. 1-3, the valve body 128 has a valve chamber 130. In FIG. 7A, the valve body 128 is shown in a closed position, and in FIG. 7B, the valve body 128 is shown in an open position. A first side of the valve body 128 is fluidly engaged with a lower access port 132, which is in turn in fluid communication with a lower annular access bore 133. A second side of the valve body 128 is fluidly engaged with an upper access port 134, which is in turn in fluid communication with an upper annular access bore 135. As discussed above with regard to the embodiment of FIGS. 2A-2B, the upper annular access bore 135 may have a profile 131 to accept a backup plug (not shown), thereby allowing for closing of the upper annular access bore 135 if desired.

FIGS. 7A and 7B, the flow path of annular fluid is shown by arrows P. When the valve body 128 is in a closed position, as shown in FIG. 7A, the valve chamber 130 does not align with the lower access port 132, and fluid is presented from flowing from the lower access port 132 into the valve chamber 130. Thus, fluid communication between the lower access port 132 and the upper access port 134 is prevented.

Conversely, when the valve body 128 is in an open position, as shown in FIG. 7B, the valve chamber 130 aligns with the lower access port 132. Thus, fluid is free to flow from the lower access port 132 into the valve chamber 130. The valve chamber 130 is also open to the upper access port 134, as described in greater detail below, so that when the valve body 128 is open, fluid may freely flow from the lower access port 132, through the valve chamber 130, and into the upper access port 134, thereby providing fluid access from the lower access port 132 to the upper access port 134 of the tubing hanger 18.

Also shown in FIGS. 7A and 7B are an upper hydraulic control line 136 and a lower hydraulic control line 138, which, may be accessed through the production tree or running tool. Upper hydraulic control line 136 provides hydraulic fluid to an area 140 above the valve chamber 130, and allows for hydraulic control of the position of the valve body 128 from above. For example, when the valve body 128 is in an open position, as shown in FIG. 7B, hydraulic fluid can be provided to area 140, thereby providing a hydraulic force $F_D$ on the valve body that acts in a downward direction. Such a hydraulic force $F_D$ pushes the valve body 128 downward from the open position to the closed position. Conversely, lower hydraulic control line 138 may provide hydraulic fluid to an area 142 below the valve chamber 130, and allow for hydraulic control of the position of the valve body 128 from below. For example, when the valve body 128 is in a closed position, as shown in FIG. 7A, hydraulic fluid can be provided to area 142, thereby providing a hydraulic force $F_U$ on the valve body that acts in an upward direction. Such a hydraulic force $F_U$ pushes the valve body 128 upward from the closed to the open position. Accordingly, the position of the valve body 128 can be controlled by means of the upper and lower control lines 136, 138, operated either individually or in combination. Alternatively, in some embodiments, lines 136, 138 may be vent lines which allow air to enter and exit the areas 140, 142 above and below the valve chamber 130 as the valve body 128 moves between open and closed positions. Furthermore, standard slim couplers, as used on various known tubing hanger systems, may be used to control hydraulic valves connected to the hydraulic lines 136, 138.

Also shown in FIGS. 7A and 7B is a biased mechanism 144 which, in the particular embodiment shown, is a spring. The biased mechanism 144 is housed above the valve chamber 130 in a recess 146, and is arranged to provide a constant force on the valve body 128 in a downward direction. The biased mechanism 144 is useful to push the valve body 128 into a closed position in case a malfunction occurs in the hydraulic control lines 136, 138. The constant downward force on the valve body 128 provided by the biased mechanism 144 provides a safeguard to ensure that in the absence of opposing hydraulic control forces, the valve body 128 remains in the closed position. Although the biased mechanism 144 is shown as a spring, any other type of biased mechanism could be used.

As shown in FIGS. 7A and 7B, line 138 may run vertically down through the tubing hanger 18, and then horizontally across to communicate with area 142. The bottom of area 142 acts as the stop position for the valve body 128 as it moves into the closed position. Line 136 may be drilled at an angle from the top of the tubing hanger 18 to the area 140.

Figure 8:
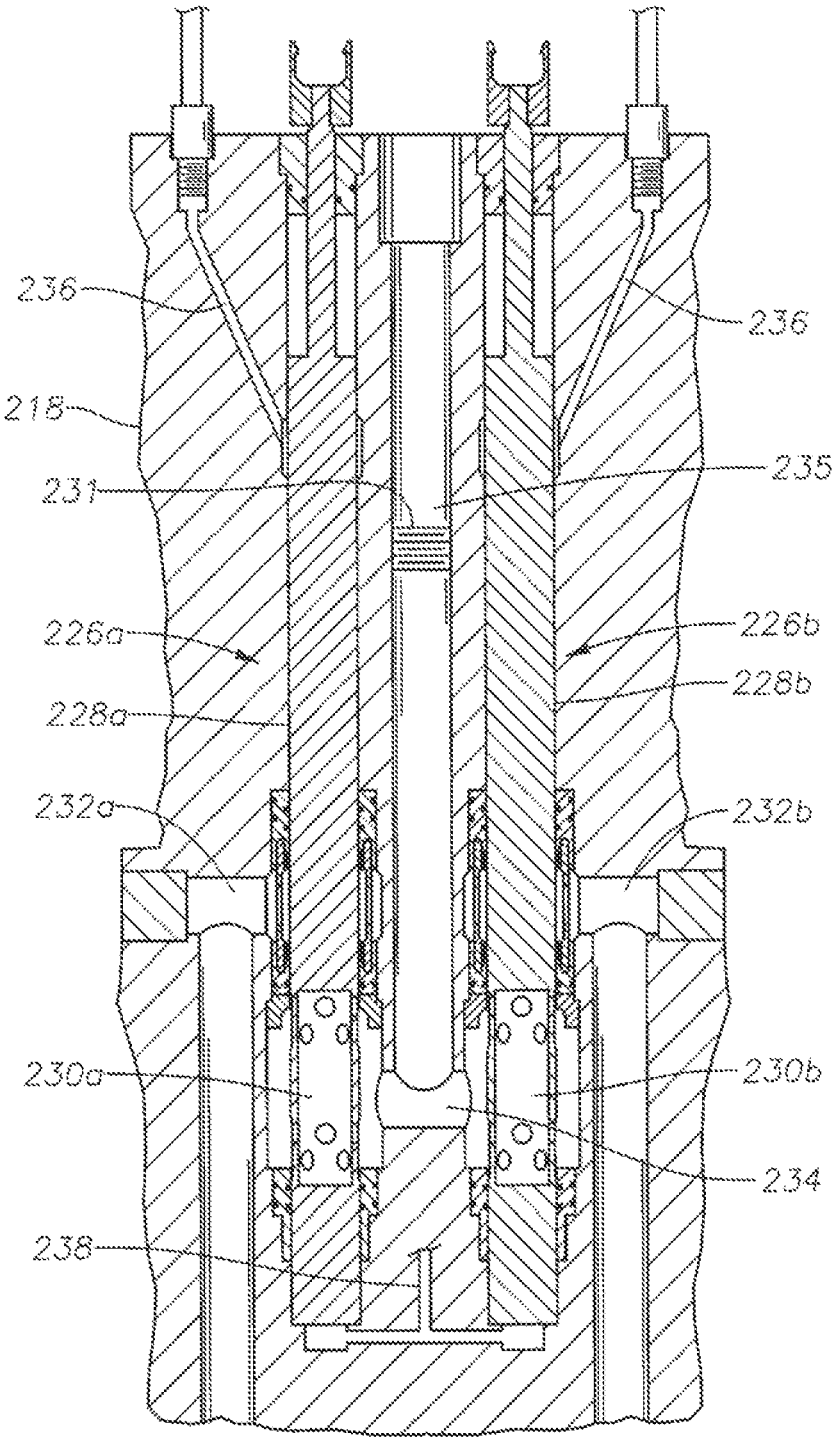
FIG. 8 is a side cross-sectional view of an embodiment of the present technology having two perforated stems in a parallel configuration.
Figure 9:
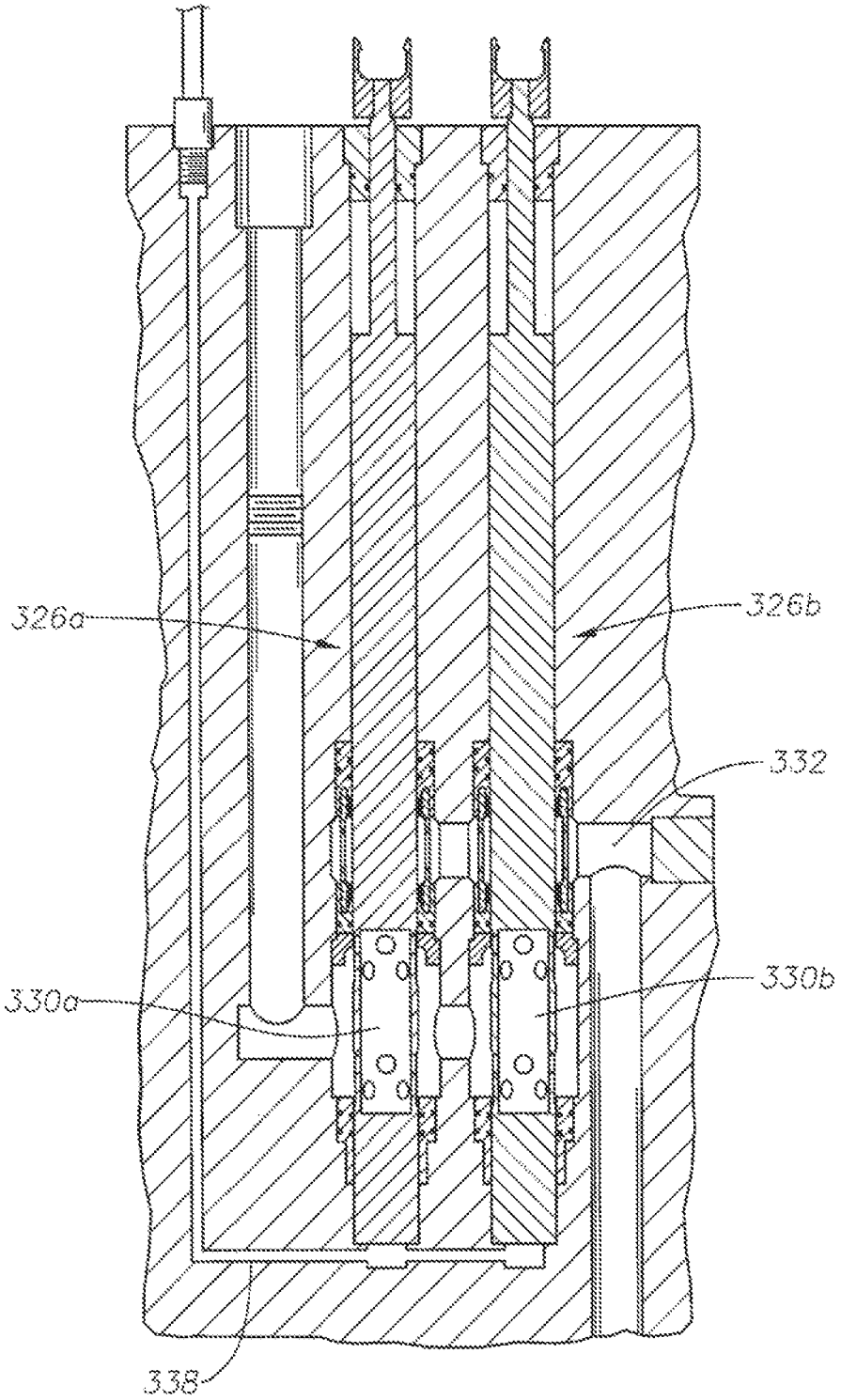
FIG. 9 is a side cross-sectional view of an alternate embodiment having two perforated stems in a parallel configuration.
Figure 10:
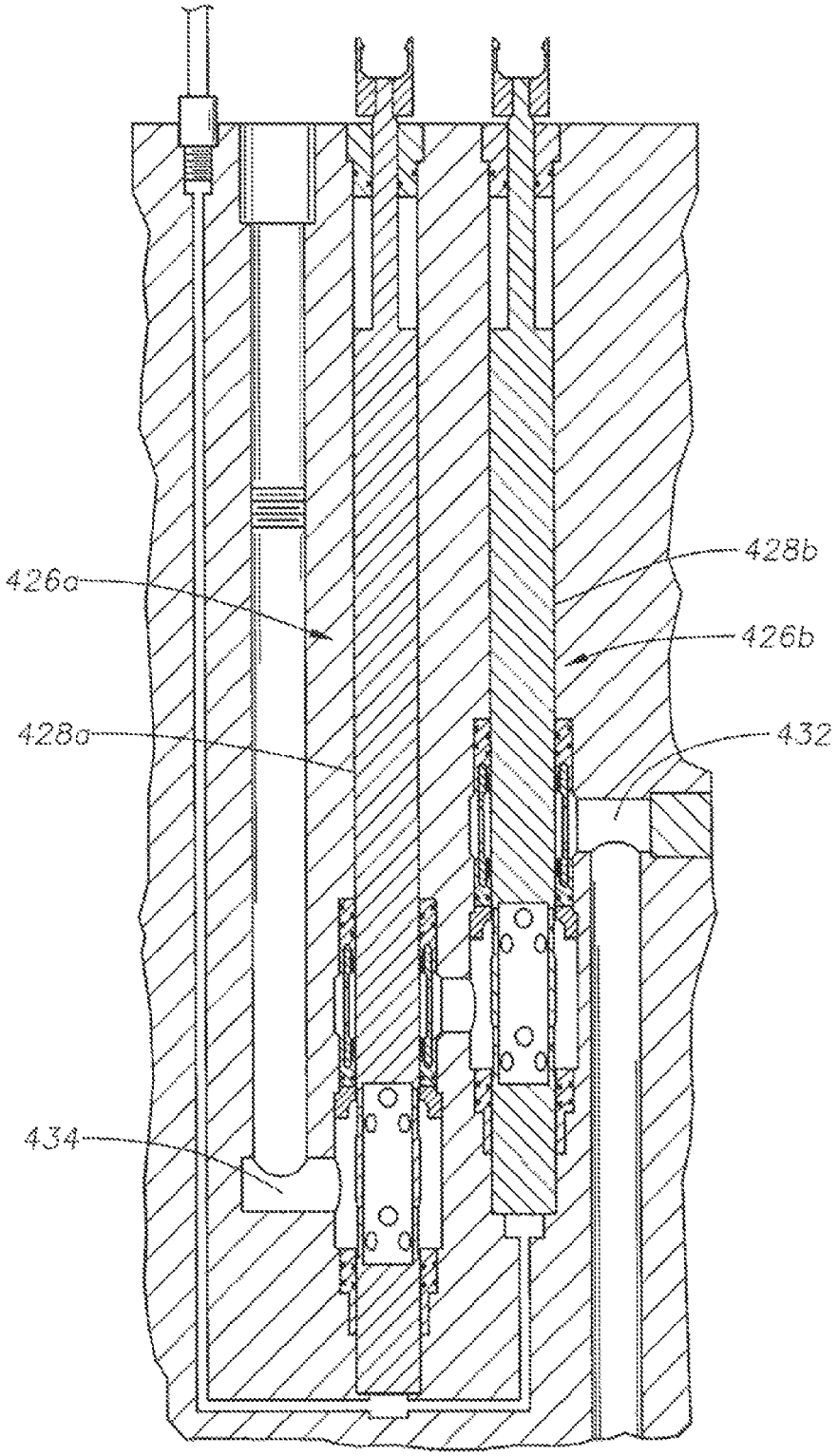
FIG. 10 is a side cross-sectional view of an embodiment of the present technology having two perforated stems arranged in series.

FIGS. 8-10 show alternative embodiments of the present technology wherein more than one annular access assembly 226 is included in a single tubing hanger 218 having an upper annular access bore 235. As discussed above with regard to the embodiment of FIGS. 2A-2B, the upper annular access bore 235 may have a profile 231 to accept a backup plug (not shown), thereby allowing for closing of the upper annular access bore 235 if desired. In FIG. 8, two annular access assemblies 226*a*, 226*b* are shown arranged in a parallel configuration. In this embodiment, each annulus access assembly 226*a*, 226*b* has a valve body 228*a*, 228*b* with a value chamber 230*a*, 230*b*. In FIG. 8, the valve bodies 228*a*, 228*b* are shown in a closed position. A first side of each valve body 228*a*, 228*b* is fluidly engaged with a separate lower access port 232*a*, 232*b*. A second side of each valve body 228*a*, 228*b* is fluidly engaged with an upper access port 234. The use of two separate lower access ports 232*a*, 232*b* allows access to two different places in the annulus.

As described above with reference to a single annulus access assembly 26, when the valve bodies 228*a*, 228*b* are in closed positions, the valve chambers 230*a*, 230*b* do not align with the lower access ports 232*a*, 232*b*, and fluid is prevented from flowing from the lower access ports 232*a*, 232*b* into the valve chambers 230*a*, 230*b*. Conversely, when the valve bodies 228*a*, 228*b* are in an open position (as shown in the analogous example of FIG. 2B), the valve chambers 230*a*, 230*b* align with the lower access ports 232*a*, 232*b*. Thus, fluid is free to flow from the lower access ports 232*a*, 232*b* into the valve chambers 230*a*, 230*b*. The valve chambers 230*a*, 230*b* are also open to the upper access port 234 so that when the valve bodies 228*a*, 228*b* are open, fluid may freely flow from the lower access ports 232*a*, 232*b*, through the valve chambers 230*a*, 230*b*, and into the upper access port 234.

Also shown in FIG. 8 is a lower hydraulic control line 238. The lower hydraulic control line 238 provides hydraulic fluid to the valve bodies 228*a*, 228*b* below the valve chambers 230*a*, 230*b*, and allows for hydraulic control of the position of the valve bodies 228*a*, 228*b* from below. Accordingly, the position of the valve bodies 228*a*, 228*b* can be controlled by means of the lower control line 238. Lines 236, 238 may alternatively be vent lines. Although FIG. 8 shows a single lower hydraulic control line 238 in hydraulic communication with both valve bodies 228*a*, 228*b*, it is to be understood that the technology alternatively contemplates two separate lower hydraulic control lines, with one line running to each valve body individually.

Other components, such as upper and lower metals seals, elastomeric seals, a stem seal ring, a seal spacer, and an override head may be included with each of the parallel annulus access valve assemblies 226*a*, 226*b*, and have the same structure and functions as related counterparts discussed above in relation to annulus access valve assembly 26.

The embodiment shown in FIG. 9 also includes two annular access assemblies 326*a*, 326*b* arranged in a parallel configuration and including valve bodies 328*a*, 328*b* and valve chambers 330*a*, 330*b*. The annular access assemblies 326*a*, 326*b* also include features discussed above, such as upper and lower metals seals, elastomeric seals, a stem seal, ring, a seal spacer, and an override head, and have the same structure and functions as related counterparts discussed above in relation to annulus access valve assembly 26. One difference between the embodiment of FIG. 9, however, and that shown in FIG. 8, is that both annular access assemblies 326*a*, 326*b* of FIG. 9 are attached to a single lower access port 332. In the embodiment shown, both valve bodies 328*a*, 328*b* are in a closed position.

Also shown in FIG. 9 is a lower hydraulic control line 338. The lower hydraulic control line 338 provides hydraulic fluid to the valve bodies 328*a*, 328*b* below the valve chambers 330*a*, 330*b*, and allows for hydraulic control of the position of the valve bodies 328*a*, 328*b* below the valve chambers 330*a*, 330*b* from below. The lower hydraulic control lines can be singular or plural.

In FIG. 10 there is shown yet another pair of annulus access assemblies 426*a*, 426*b*. In FIG. 10, however, the annulus access assemblies 426*a*, 426*b* are provided in series. Thus, in order for annular fluid to pass from the lower access port 432 to the upper access port 434, both valve bodies 428*a*, 428*b* must be positioned in the open position. If either valve body 428*a*, 428*b* is in the closed position, fluid will not be able to pass through the closed valve body. Other than the configuration of the annulus access assemblies 426*a*, 426*b* in series, the existence and arrangement the components associated with each annulus access assembly 426*a*, 426*b* is the same as that shown and described above.

Embodiments of the present technology that include more than one annular access assembly may be advantageous because they provide redundancy to the system. For example, in the case of the parallel annulus access assemblies 226*a*, 226*b* of FIG. 8, the annulus can be accessed via more than one annulus access port, thereby providing multiple samples of the annular fluid to add a degree of confidence that the fluid being analyzed is representative of the fluid as a whole in the annulus. In the case of the parallel annular access assemblies 326*a*, 326*b* in FIG. 9, the provision of two assemblies means that if one assembly becomes inoperable and is stuck in the closed position, flow from the lower access port 332 can still be controlled using the remaining assembly. Finally, in the case of the series of annulus access assemblies shown in FIG. 10, the failure of one valve body to close does not mean that access to the annulus must remain open because the other assembly can still be closed. Although three possible configurations of annulus access assemblies are shown in FIGS. 8-10, these are only exemplary of many possible embodiments and should not be interpreted as limiting the scope of arrangements contemplated by the present technology.

While the technology has been shown or described in only some of its forms, it should be apparent to those skilled in the art that it is not so limited, but is susceptible to various changes without departing from the scope of the invention. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A wellhead assembly, comprising:

a tubing hanger adapted to be connected to a tubing string and landed in a wellhead, defining a tubing annulus between the tubing string and casing in a well;

a communication cavity within the tubing hanger;

a remotely actuated valve within the communication cavity;

a tubing annulus upper access bore extending downward from an upper end of the tubing hanger to the communication cavity on a first side of the valve;

a tubing annulus lower access bore communicative with the tubing annulus and extending upward from a lower end of the tubing hanger to the communication cavity on a second side of the valve, wherein the valve selectively opens and closes communication between the tubing annulus upper access bore and the tubing annulus lower access bore;

an axially extending flow chamber contained within the valve;

a first lateral port extending from the lower access bore to the flow chamber; and a second lateral port extending from the upper access bore to the flow chamber.

2. The wellhead assembly of the claim 1, wherein the first lateral port is at a higher elevation than the second lateral port.

3. The wellhead assembly of claim 1, wherein the valve is an axially moveable valve stem having a flow chamber defined by a closed bottom, a closed top, and a cylindrical sidewall having perforations, wherein when the valves is in an open position, the flow chamber is in communication with the first and second lateral ports, and when the valve is in a closed position, communication between the flow chamber and at least one of the lateral ports is blocked.

4. The wellhead assembly of claim 3, wherein the perforations comprise at least one upper perforation and at least one lower perforation, with a cylindrical sealing surface between the upper and lower perforations, the wellhead assembly further comprising:

an upper seal spaced above the lateral ports; and a lower seal spaced below the lateral ports;

so that while the valve is in the open position, the upper seal engages the valves stem above the flow chamber, and while the valve is in the lower position, the lower seal engages the cylindrical sealing surface of the stem below the flow chamber.

5. The wellhead assembly of claim 4, further comprising:

a perforated seal spacer positioned between the upper and lower seals to help maintain the relative positions of the upper and lower seals as the valve moves between open and closed positions.

6. The wellhead assembly of claim 1, further comprising:

control ports in the tubing hanger that controls hydraulic pressure in an area above and below the valve to move the valve between open and closed positions.

7. A wellhead assembly, comprising:

a tubing hanger adapted to be connected to a tubing string and landed in a wellhead, defining a tubing annulus between the tubing string and casing in a well;

a communication cavity within the tubing hanger;

a remotely actuated valve within the communication cavity, the valve movable between open and closed positions;

a tubing annulus upper access bore extending downward from an upper end of the tubing hanger to the communication cavity on a first side of the valve; and a tubing annulus lower access bore communicative with the tubing annulus and extending upward from a lower end of the tubing hanger to the communication cavity on a second side of the valve, wherein the valve selectively opens and closes communication between the tubing annulus upper access bore and the tubing annulus lower access bore, wherein the upper and lower tubing annulus access bores are parallel to each other and circumferentially spaced apart, wherein the communication cavity connects the upper and lower access bores within the tubing hanger and extends axially parallel to the access bores and circumferentially spaces between the access bores.

8. The wellhead assembly of claim 7, further comprising:

an axially extending flow chamber contained within the valve;

a first lateral port extending from the lower access bore to the flow chamber; and a second lateral port extending from the upper access bore to the flow chamber.

9. The wellhead assembly of claim 8, wherein the first lateral port is at a higher elevation than the second lateral port.

10. The wellhead assembly of claim 8, wherein the valve is an axially moveable valve stem having a flow chamber defined by a closed bottom, a closed top, and a cylindrical sidewall having perforations, wherein when the valve is in an open position, the flow chamber is in communication with the first and second lateral ports, and when the valve is in a closed position, communication between the flow chamber and at least one of the lateral ports is blocked.

11. The wellhead assembly of claim 10, wherein the perforations comprise at least one upper perforation and at least one lower perforation, with a cylindrical sealing surface between the upper and lower perforations, the wellhead assembly further comprising:

an upper seal spaced above the lateral ports; and a lower seal spaced below the lateral ports;

so that while the valve is in the open position, the upper seal engages the valve stem above the flow chamber, and while the valve is in the lower position, the lower seal engages the cylindrical sealing surface of the stem below the flow chamber.

12. The wellhead assembly of claim 11, further comprising;

a perforated seal spacer position between the upper and lower seals to help maintain the relative positions of the upper and lower seals as the valve moves between open and closed positions.

13. A wellhead assembly, comprising;

a wellhead housing attached to a wellhead;

a production tree having a production bore and attached to the top of the wellhead housing;

a tubing hanger adapted to be connected to a tubing string and landed in the wellhead housing, the tubing hanger having a production bore and defining a tubing annulus between the tubing string and casing in well;

a communication cavity within the tubing hanger;

a remotely actuated valve within the communication cavity, the valve movable between open and closed positions;

an isolation sleeve positioned between the tubing hanger and the production tree, the isolation sleeve having a bore that provides fluid communication between the production bore of the tubing hanger and the production bore of the production tree;

a tubing annulus upper access bore extending downward from an upper end of the tubing hanger to the communication cavity on a first side of the valve;

a tubing annulus lower access bore communicative with the tubing annulus and extending upward from a lower end of the tubing hanger to the communication cavity on a second side of the valve, wherein the valve selectively opens and closes communication between the tubing annulus upper access bore and the tubing annulus lower access bore, and wherein the upper and lower tubing annulus access bores are parallel to each other and circumferentially spaced apart; and wherein the communication cavity connects the upper and lower access bores within the tubing hanger and extends axially parallel to the access bores and circumferentially spaced between the access bores.

14. The wellhead assembly of claim 13, further comprising;

a first lateral port extending from the lower access bore to a flow chamber of the valve, the flow chamber having walls with perforations extending therethrough; and a second lateral port extending from the upper access bore to the flow chamber.

15. The wellhead assembly of claim 14, wherein the first lateral port is at a higher elevation than the second lateral port.

16. The wellhead assembly of claim 14, wherein when the valve is an open position, the flow chamber is in a communication with the first and second lateral ports, and when the valve is in a closed position, communication between the flow chamber and at least one of the lateral ports is blocked.

17. The wellhead assembly of claim 16, wherein the perforations compromise at least one upper perforation and at least one lower perforation, with a cylindrical sealing surface between the upper and lower perforations, the wellhead assembly further comprising;

an upper seal spaced above the lateral ports; and a lower seal spaced below the lateral ports;

wherein while the valve is in the open position, the upper seal engages the valve stem above the flow chamber, and while the valve is in the closed position, the lower seal engages the cylindrical sealing surface of the stem below the flow chamber.

18. The wellhead assembly of claim 17, further comprising:

a perforated seal spacer positioned between the upper and lower seals to help maintain the relative positions of the upper and lower seals as the valve moves between open and closed positions.

19. The wellhead assembly of claim 13, further comprising:

an override head attached to the top of the valve and having a circumferential inward protrusion at the top edge thereof, the circumferential inward protrusion positioned to engage an override assembly of the production tree attached to the wellhead housing, the override assembly capable of moving to override head and valve between an open and a closed position.

* * * * *